US011845165B2

(12) United States Patent
Hsieh

(10) Patent No.: US 11,845,165 B2
(45) Date of Patent: Dec. 19, 2023

(54) TUBULAR BODY OF ELECTRONIC TORQUE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 176 days.

(21) Appl. No.: 16/531,042

(22) Filed: Aug. 3, 2019

(65) Prior Publication Data

US 2020/0180129 A1 Jun. 11, 2020

(30) Foreign Application Priority Data

Dec. 6, 2018 (TW) ..... 107143999

(51) Int. Cl.

| | |
|---|---|
| ***B25B 23/16*** | (2006.01) |
| ***B25B 23/142*** | (2006.01) |
| ***B25G 1/10*** | (2006.01) |
| ***B25B 23/00*** | (2006.01) |

(52) U.S. Cl.

CPC ..... *B25B 23/16* (2013.01); *B25B 23/0028* (2013.01); *B25B 23/1425* (2013.01); *B25G 1/102* (2013.01)

(58) Field of Classification Search

CPC ... B25B 23/1427; B25B 23/141; B25B 23/14; B25B 23/142; B25B 13/48; B25B 23/16; B25B 23/0028; B25B 23/1425; B25B 23/0021; B25B 23/00; B25G 1/102; B25G 1/10

See application file for complete search history.

(56) References Cited

U.S. PATENT DOCUMENTS

| | | | | |
|---|---|---|---|---|
| 1,832,663 | A * | 11/1931 | Small | B25B 17/00 81/57.29 |
| 3,577,815 | A * | 5/1971 | Bergquist | B25B 23/1427 81/483 |
| 3,707,893 | A * | 1/1973 | Hofman | B25B 17/00 81/57.29 |
| 4,669,319 | A * | 6/1987 | Heyraud | B25B 23/1425 81/477 |
| 4,982,612 | A * | 1/1991 | Rittmann | G01L 1/225 73/862.26 |

(Continued)

FOREIGN PATENT DOCUMENTS

| | | |
|---|---|---|
| JP | 3189162 U | 2/2014 |
| JP | 6258169 B | 1/2018 |

(Continued)

*Primary Examiner* — Robert J Scruggs

(74) *Attorney, Agent, or Firm* — CKC & Partners Co., LLC

(57) ABSTRACT

A tubular body for an electronic torque wrench is integrally formed and includes a small diameter portion, a bridge portion, and a large diameter portion connected along the longitudinal direction of the tubular body. The bridge portion has a small diameter end connected to the rear end of the small diameter portion and an opposite large diameter end connected to the front end of the large diameter portion. As there is no gap at the junction between the large diameter portion and the small diameter portion, the tubular body is dustproof, has a lower production cost and higher structural strength, and makes an electronic torque wrench a better appearance.

12 Claims, 5 Drawing Sheets

(56) References Cited

U.S. PATENT DOCUMENTS

| | | | | |
|---|---|---|---|---|
| 5,734,113 | A * | 3/1998 | Vogt | A61B 17/8875 73/1.12 |
| 7,000,508 | B2 * | 2/2006 | Li | B25B 23/1425 81/467 |
| 2005/0072278 | A1 * | 4/2005 | Cutler | B25B 23/1425 81/467 |
| 2009/0178519 | A1 * | 7/2009 | Hsieh | B25B 23/1425 81/467 |
| 2009/0255385 | A1 * | 10/2009 | Hsieh | B25B 23/1425 81/467 |
| 2011/0185861 | A1 * | 8/2011 | Hu | B25G 1/066 81/467 |
| 2014/0165798 | A1 * | 6/2014 | Hsieh | B25B 13/463 81/479 |
| 2014/0338419 | A1 * | 11/2014 | Hsieh | G01L 25/003 81/477 |
| 2017/0348836 | A1 * | 12/2017 | Hu | B25G 1/063 |

FOREIGN PATENT DOCUMENTS

| | | | |
|---|---|---|---|
| JP | 2018-130820 | A | 8/2018 |
| JP | 3217757 | U | 8/2018 |

* cited by examiner

TUBULAR BODY OF ELECTRONIC TORQUE WRENCH

BACKGROUND OF THE INVENTION

1. Technical Field

The present invention relates to a torque tool and more particularly to the tubular body of an electronic torque wrench.

2. Description of Related Art

A torque wrench has a tubular body, a plurality of components mounted on the tubular body, and a working head mounted at a front end of the tubular body. An electronic torque wrench uses electronic components to set the torque value to be applied and sense the torque applied, so the number of components required by an electronic torque wrench and the total volume of the components are both smaller than those of a mechanical torque wrench. An electronic torque wrench has a relatively small number of components, its tubular body need not have a large interior space. This explains why the tubular body of an electronic torque wrench seldom has a uniform outer diameter throughout but has a relatively small outer diameter at the junction between the working head and the tubular body (hereinafter referred to as the small diameter portion) to reduce the weight, volume, and material of the wrench. The relatively large deflection and deformation of the small diameter portion also allow the torque applied to be sensed more precisely.

FIG. 1 shows a sectional view of a conventional tubular body 10 of an electronic torque wrench. In the prior art, the tubular body 10 includes a large tube 14, a small tube 12 partially fitted into the large tube 14, and a plurality of coupling elements 16 (e.g., pins) for connecting the tubes 12 and 14 fixedly together. The small tube 12 forms the aforesaid small diameter portion.

After actual use, however, it was found that the tubular body 10 has many drawbacks. First, Since the tubular body 10 is sleeved by the large and small tubes 14, 12, a gap 18 is formed at the junction of the two tubes 12 and 14, dust tends to enter the tubular body 10 through the gap 18, that is to say, the conventional tubular body 10 is not dustproof. The electronic components in the tubular body 10, therefore, may end up covered with dust such that their service lives and accuracy are compromised.

Second, the conventional tubular body 10, which includes tubes of different diameters fitted together and secured by the coupling elements 16, has a relatively high production cost and assembly cost. Moreover, since at the junction the large and small tubes 14 and 12 have a gap and the tubes are not tightly attached, the structural strength of the tubular body is weak, and the gapped junction is also unsightly. The foregoing drawbacks of the conventional tubular body of an electronic torque wrench have yet to be overcome.

BRIEF SUMMARY OF THE INVENTION

The primary objective of the present invention is to overcome the aforesaid drawbacks by providing a tubular body for an electronic torque wrench wherein the tubular body includes a large diameter portion and a small diameter portion and is dustproof at the junction between the two portions.

Another objective of the present invention is to provide a tubular body for an electronic torque wrench wherein the tubular body can be manufactured at a lower cost than its prior art counterparts.

Still another objective of the present invention is to provide a tubular body for an electronic torque wrench wherein the structural strength of the tubular body is enhanced.

Yet another objective of the present invention is to provide a tubular body for an electronic torque wrench wherein the tubular body has a more beautiful appearance.

The present invention provides a tubular body for an electronic torque wrench, wherein the tubular body has an integrally formed structure and includes a small diameter portion, a bridge portion, and a large diameter portion;

the small diameter portion, the bridge portion, and the large diameter portion are sequentially connected along the longitudinal direction of the tubular body; the outer diameter of the large diameter is larger than that of the small diameter portion;

the bridge portion has two ends connected respectively to a rear end of the small diameter portion and a front end of the large diameter portion; and the length of the tubular body is 1.18~2.6 times the length of the large diameter portion, and the length of the small diameter portion is 0.18~1.6 times the length of the large diameter portion.

Accordingly, the junction between the large diameter portion and the small diameter portion is free of gaps and therefore dustproof. The tubular body is integrally formed rather than assembled from two tubes of different outer diameters and hence has a lower production cost and higher structural strength and makes a better looking wrench than the conventional tubular bodies.

Preferably, the length of the bridge portion is 0.085~0.32 times the length of the large diameter portion.

The tubular body further has an opening in the peripheral wall of the large diameter portion.

Preferably, the length of the opening does not exceed one half of the length of the large diameter portion, and the depth of the opening is approximately one half of the outer diameter of the large diameter portion.

The distance from the front end of the tubular body to the rear end of the opening is defined as a layout length, and the layout length is preferably 0.67~0.86 times the length of the tubular body.

BRIEF DESCRIPTION OF THE SEVERAL VIEWS OF THE DRAWINGS

The objectives, features, and intended effects of the present invention can be better understood by referring to the following detailed description of two preferred embodiments of the invention with the accompanying drawings, in which.

DETAILED DESCRIPTION OF THE INVENTION

Figure 1:
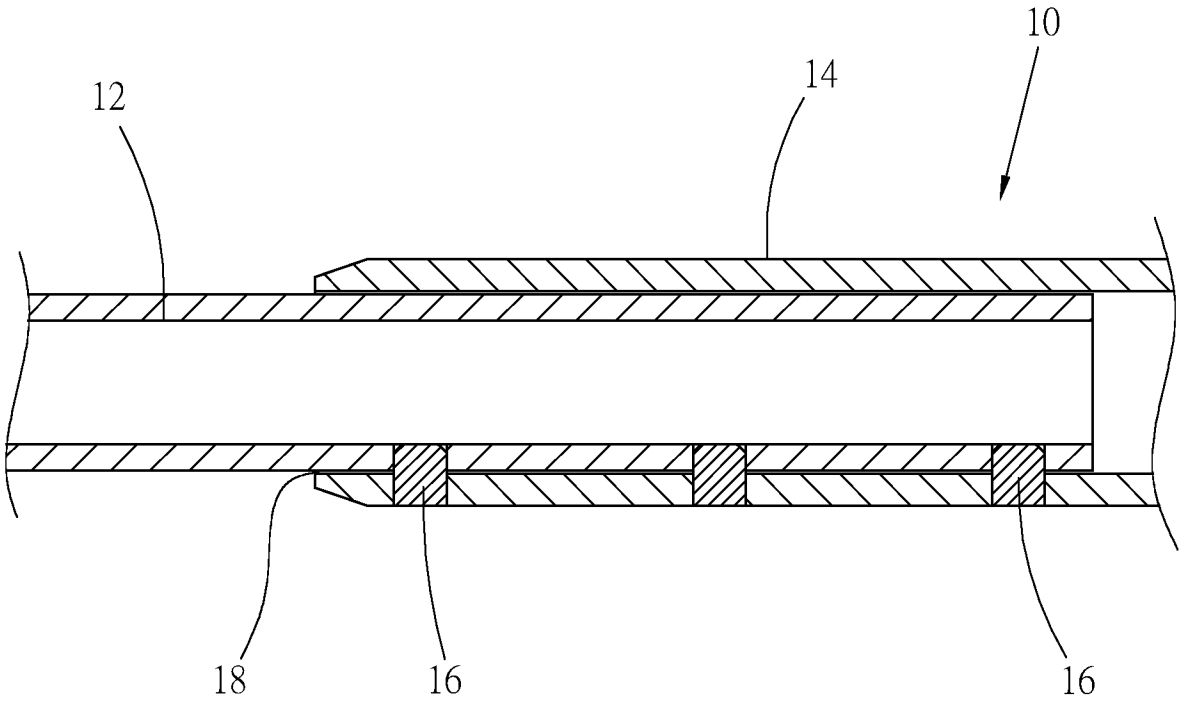
Fig. 1 PRIOR ART
FIG. 1 is a partial longitudinal sectional view of the conventional tubular body of an electronic torque wrench.
Figure 2:
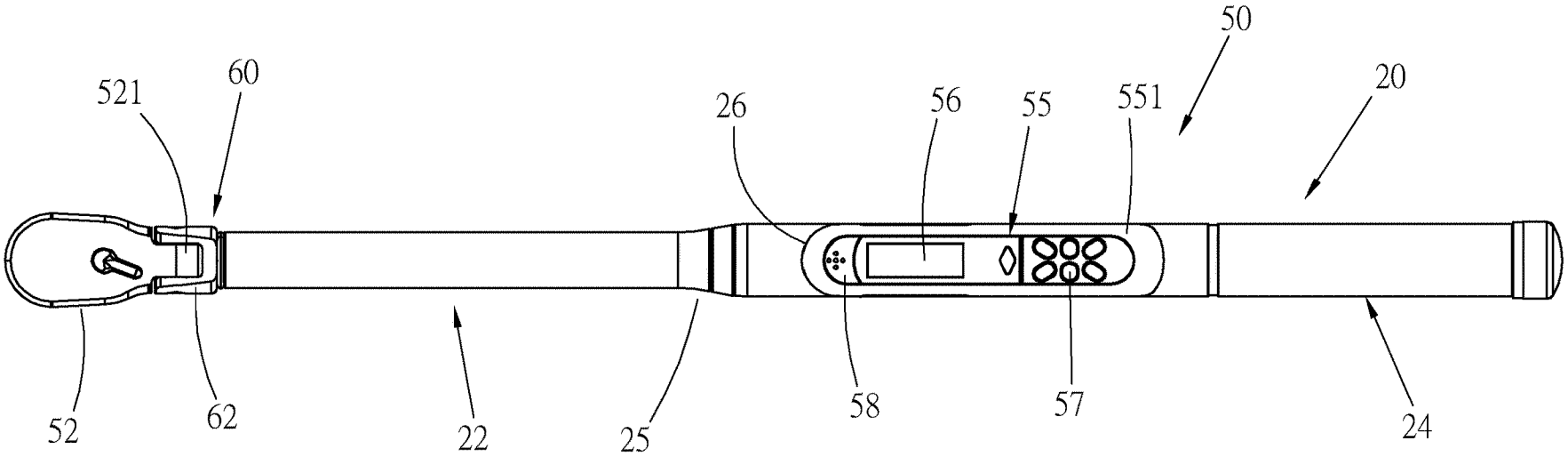
FIG. 2 is a top view of an electronic torque wrench made of the tubular body according to a preferred embodiment of the invention.
Figure 3:
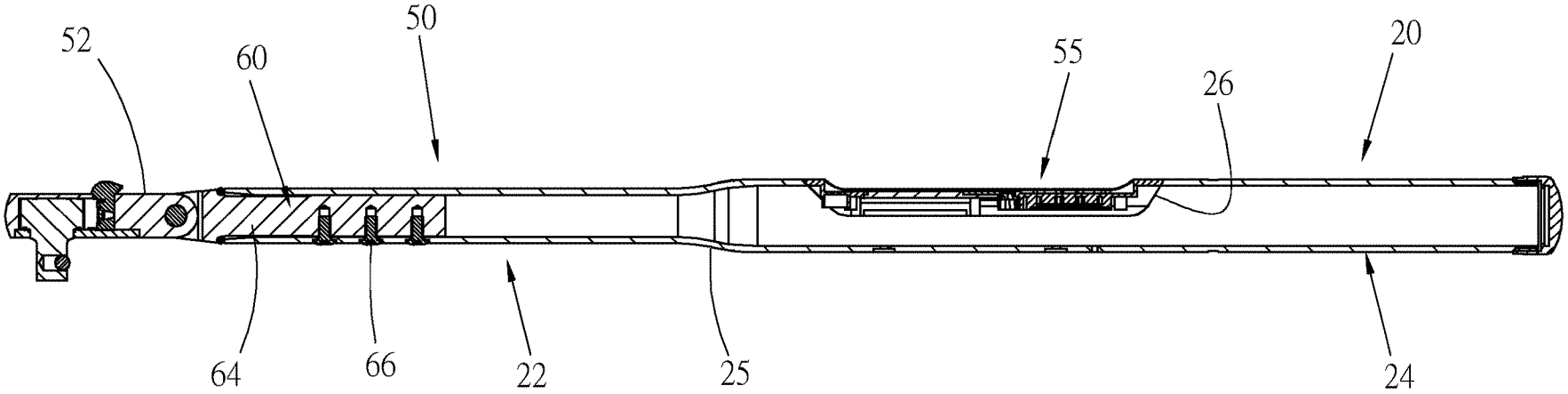
FIG. 3 is a longitudinal sectional view of the electronic torque wrench in FIG. 2.

Please refer to FIG. 2 and FIG. 3 respectively for a top view and a longitudinal sectional view of an electronic torque wrench 50 made of the tubular body 20 provided by the first preferred embodiment of the present invention. The tubular body 20 has a small diameter portion 22 and a large diameter portion 24 connected to each other in the longitudinal direction of the tubular body 20. A working head 52 is disposed at a front end of the small diameter portion 22 of the tubular body 20. The working head 52 shown in the drawings of this embodiment serves illustrative purposes only and is by no means limiting. An operation and display interface 55 is disposed at the large diameter portion 24 and has at least one display screen 56, a plurality of press keys 57, at least one alerting element 58 (for issuing a light alert and/or a sound alert), a circuit board (not shown), and a software program. The interface 55 functions as a man-machine interface to facilitate the input of the required setting values or parameters and to provide alerts.

Figure 4:
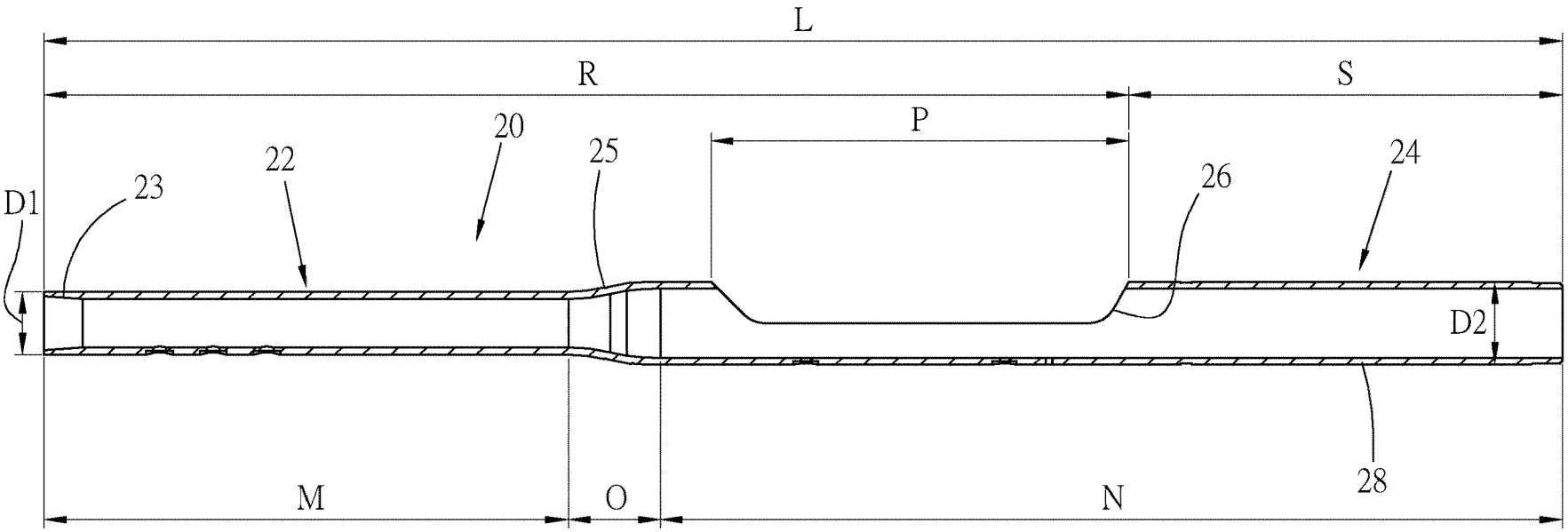
FIG. 4 is a longitudinal sectional view of the tubular body of the present invention 3.

Referring to FIG. 4, the tubular body 20 further includes a bridge portion 25 connected between the small diameter portion 22 and the large diameter portion 24. As their names suggest, the diameter of the small diameter portion 22 is smaller than the diameter of the large diameter portion 24. The bridge portion 25 lies between the large and small diameter portions and has its front and rear ends connected respectively to the rear end of the small diameter portion 22 and the front end of the large diameter portion 24 in order for the tubular body 20 to have a one-piece structure. The bridge portion 25 in this embodiment is in the form of a cone whose front end is a small diameter end and is connected to the rear end of the small diameter portion 22, and whose rear end is a large diameter end and is connected to the front end of the large diameter portion 24. The tubular body 20 is made by rolling or extrusion such that the small diameter portion 22, the bridge portion 25, and the large diameter portion 24 are integrally formed.

In the preferred embodiment shown in FIG. 4, the tubular body 20 has a length L, the small diameter portion 22 has a length M, the large diameter portion 24 has a length N, the bridge portion 25 has a length O, and the aforesaid lengths are in specific ratios. Here, the length N of the large diameter portion 24 is used as the base value, and the lengths of the other portions are defined by ratios to the length N of the large diameter portion 24 as follows. The ratio of the length L of the tubular body 20 to the length N of the large diameter portion 24 is 1.18~1.65:1 and preferably 1.2~1.6:1; in other words, the length L of the tubular body 20 is 1.18~1.65 times, preferably 1.2~1.6 times, the length N of the large diameter portion 24. The length M of the small diameter portion 22 is 0.55~0.62 times, preferably 0.56~0.6 times, the length N of the large diameter portion 24. The length O of the bridge portion 25 is 0.085~0.12 times, preferably 0.09~0.11 times, the length N of the large diameter portion 24.

The small diameter portion 22 has an outer diameter D1, and the large diameter portion 24 has an outer diameter D2, wherein the outer diameter D1 is 0.7~0.8 times, preferably 0.75~0.78 times, the outer diameter D2. The foregoing length and outer diameter ratios produce the preferred structural proportion of the tubular body 20 and can satisfy the requirement in structural strength as well as in the comfortableness of operation.

Figure 5:
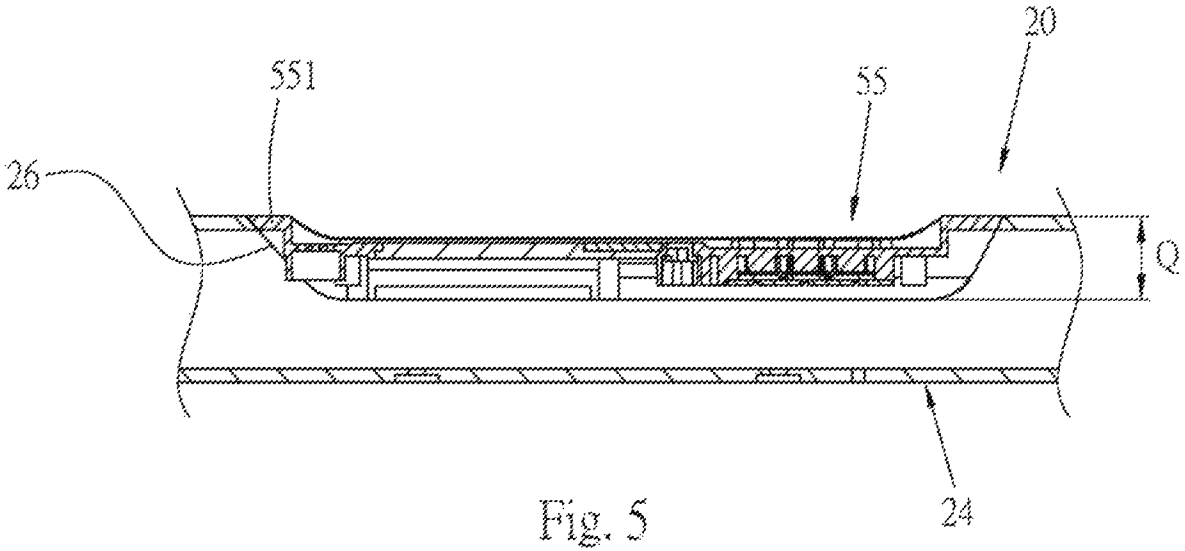
FIG. 5 is a partial enlarged view of the tubular body in FIG. 4 mounted with an operation and display interface.

An opening 26 is formed in a front section of the peripheral wall of the large diameter portion 24 by cutting the tubular body 20. Preferably, the opening 26 has a length P not greater than one half of the length N of the large diameter portion 24. For example, the length P of the opening 26 is 0.35~0.48 times, preferably 0.44~0.47 times, the length N of the large diameter portion 24. The rear section of the large diameter portion 24, i.e., the section rearward of the opening 26, forms a gripping area 28 of the tubular body 20 and is intended to be gripped by the user. The distance from the front end of the tubular body 20 to the rear end of the opening 26 is defined a layout length R, which limits the position of the rear end of the opening 26. The layout length R is 0.69~0.74 times, preferably 0.71~0.73 times, the length L of the tubular body 20. The gripping area 28 has a gripping area length S defined between the rear end of the opening 26 and the rear end of the tubular body 20. The gripping area length S is 0.26~0.31 times, preferably 0.27~0.29 times, the length L of the tubular body 20 and the gripping area length S is 0.45~0.51 times, preferably 0.46~0.5 times, the length N of the large diameter portion 24. Referring to FIG. 5, the opening 26 has a depth Q equal to about one half of the outer diameter D2 of the large diameter portion 24. More specifically, the depth Q of the opening 26 is 0.48~0.51 times, preferably 0.49 times, the outer diameter D2 of the large diameter portion 24. The operation and display interface 55 is disposed in the opening 26 in such a way that the housing 551 of the interface 55 covers the opening 26 completely.

Figure 6:
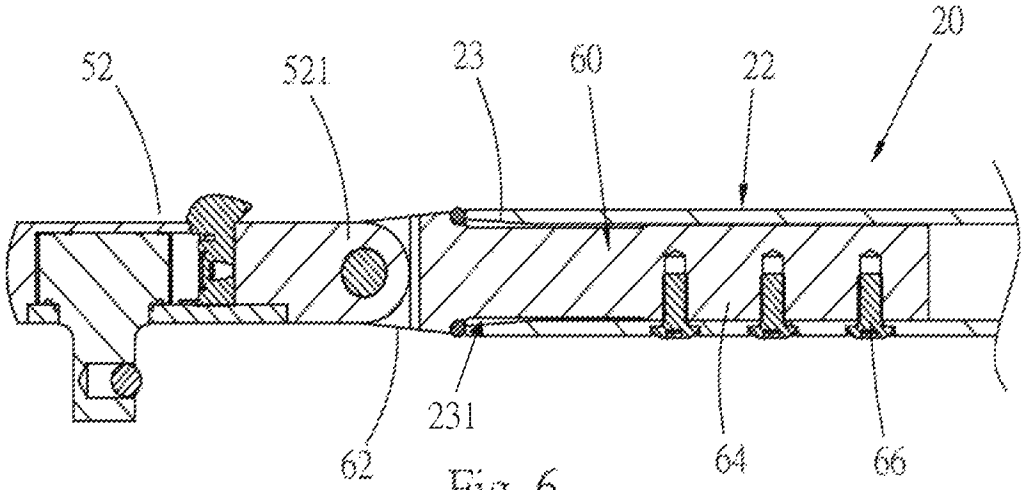
FIG. 6 is a partial enlarged view of the electronic torque wrench in FIG. 3.

Referring to FIG. 4 and FIG. 6, the inner periphery of the front end of the small diameter portion 22 is provided with a tapered annular wall 23, whose diameter is reduced inwardly. There is a connecting member 60 having a lug portion 62 and a rod portion 64. The rod portion 64 extends into the tubular body 20 through the front end of the small diameter portion 22, and the rod portion 64 and the small diameter portion 22 are threadedly fixed together by a plurality of threaded connection elements 66. The provision of the annular wall 23 makes it easier for the rod portion 64 to extend into the tubular body 20. Referring to FIG. 2, the lug portion 62 juts out of the tubular body 20 and has a width greater than the outer diameter of the small diameter portion 22. The working head 52 has a pivotal connection end 521 pivotally connected to the lug portion 62 and therefore can be rotated. The relatively great width of the lug portion 62 adds to the structural strength of the working head 52. Referring to FIG. 6, a gap 231 is presented between the tapered annular wall 23 of the front end of the small diameter portion 22 and the rod portion 64 of the connecting member 60.

When the electronic torque wrench 50 is used to rotate a threaded element (e.g., a bolt, nut, or the like), the torque applied to the wrench 50 can be known by sensing the deflection of the small diameter portion 22. The length and diameter ratios between the large diameter portion 24 and the small diameter portion 22 in this preferred embodiment provide the wrench 50 with the optimal strength and allow the small diameter portion 22 to be deflected in the optimal manner so that an accurate torque value can be obtained and a long service life, expected. The ratio of the layout length R to the length L of the tubular body 20 sets a limit on the position of the rear end of the opening 26 so that the most appropriate gripping area 28 can be formed, allowing the user to operate the wrench 50 with ease by gripping the tubular body 20.

Apart from the advantages mentioned above, the tubular body 20 of the present invention is integrally formed and therefore has no gap at the junction between the large diameter portion 24 and the small diameter portion 22, meaning the tubular body 20 is dustproof, i.e., can prevent the entry of dust and dirt.

Moreover, the one-piece configuration of the tubular body 20 makes possible a simpler manufacturing process, a shorter assembly time, and hence lower production cost than in the prior art, which entails fitting two separate tubes (i.e., a large diameter tube and a small diameter tube) together and then securing the tubes with a plurality of coupling elements.

In addition, the integrally formed tubular body 20 has higher structural strength and can cope with larger operating forces than in the prior art, and the tapered bridge portion 25, which joins the large diameter portion 24 and the small diameter portion 22 together, eliminates assembly gaps and thereby renders the tubular body 20 a better appearance and more visually pleasant.

Figure 7:
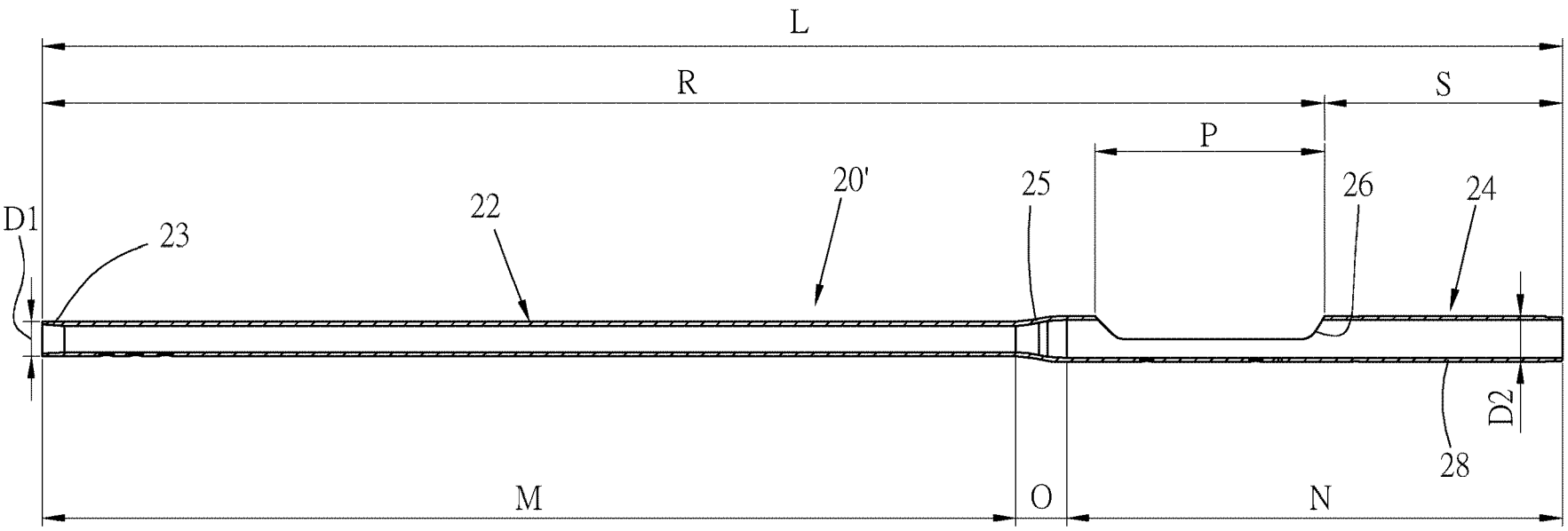
FIG. 7 is similar to FIG. 4 showing a longitudinal sectional view of the tubular body according to another preferred embodiment of the invention.

Please refer to FIG. 7 for a longitudinal sectional view of the tubular body 20' provided by a second preferred embodiment of the present invention. Like the tubular body 20, the tubular body 20' also includes a small diameter portion 22 and a large diameter portion 24 connected along the longitudinal direction of the tubular body 20', a bridge portion 25 connected between the two portions 22 and 24, and an opening 26 provided in a front section of the peripheral wall of the large diameter portion 24. For the sake of simplicity, and to facilitate understanding, the reference numerals used in the first preferred embodiment are applied to their respective components in the second preferred embodiment.

Each portion of the tubular body 20' also has a length as defined in the first preferred embodiment, and the various lengths are also defined by ratios based on the length N of the large diameter portion 24. More specifically, the length L of the tubular body 20' is 1.18~2.6 times, preferably 1.2~2.5 times, the length N of the large diameter portion 24; the length O of the bridge portion 25 is 0.085~0.32 times, preferably 0.2~0.3 times, the length N of the large diameter portion 24; and the length M of the small diameter portion 22 is 0.18~1.6 times, preferably 0.2~1.5 times, the length N of the large diameter portion 24. It is worth mentioning that the length M of the small diameter portion 22 in this embodiment may vary greatly within the aforesaid ranges, i.e., may be far less than the length N of the large diameter portion 24 or more than 1.5 times the length N of the large diameter portion 24. The layout length R is 0.67~0.86 times, preferably 0.69~0.85 times, the length L of the tubular body 20'.

The second preferred embodiment has the same effects as the first preferred embodiment shown in FIG. 4. Please refer back to the relevant paragraphs for a detailed description of those effects.

The above embodiments are only used to illustrate the present invention, not intended to limit the scope thereof. Many modifications of the above embodiments can be made without departing from the spirit of the present invention.

What is claimed is:

1. A tubular body of an electronic torque wrench, comprising:

a small diameter portion, a bridge portion, and a large diameter portion connected along a longitudinal direction of the tubular body, an outer diameter of the large diameter portion being larger than an outer diameter of the small diameter portion; the tubular body is integrally formed;

the bridge portion lies between the large diameter portion and the small diameter portion and has a front end connected to a rear end of the small diameter portion and a rear end connected to a front end of the large diameter portion; and the tubular body, the small diameter portion, and the large diameter portion have a length respectively, the length of the tubular body is 1.18~2.6 times the length of the large diameter portion, and the length of the small diameter portion is 0.18~1.6 times the length of the large diameter portion;

wherein the small diameter portion, the bridge portion, and the large diameter portion are a monolithic tubular body, the monolithic tubular body being hollow form one end to another end, when the tubular body is not assembled to components of the electronic wrench;

wherein a front end of the small diameter portion has an inner periphery provided with a tapered annular wall, the tapered annular wall has a front diameter and a rear diameter, the front diameter is larger than the rear diameter and forms an aperture for inserting a connecting member, and the tapered annular wall surrounds the connecting member;

wherein the tapered annular wall of the small diameter portion of the tubular body is formed by reducing a thickness of the front end of the small diameter portion between the inner periphery of the front end of the small diameter portion and an outer surface of the front end of the small diameter portion; the thickness of the front end of the small diameter portion is continuously reduced starting from a predetermined position of the inner periphery of the front end and extending to an outermost point of the front end of the small diameter portion; a gap is presented between the tapered annular wall of the front end of the small diameter portion and a rod portion of the connecting member, and a size of the gap gradually increases from the predetermined position of the inner periphery of the front end to the outermost point of the front end of the small diameter portion.

2. The tubular body as claimed in claim 1, wherein the bridge portion has a length, and the length of the bridge portion is 0.085~0.32 times the length of the large diameter portion.

3. The tubular body as claimed in claim 2, wherein the length of the tubular body is 1.18~1.65 times or 1.2~2.5 times the length of the large diameter portion; the length of the small diameter portion is 0.55~0.62 times or 0.2~1.5 times the length of the large diameter portion; and the length of the bridge portion is 0.09~0.11 times or 0.2~0.3 times the length of the large diameter portion.

4. The tubular body as claimed in claim 1, wherein the outer diameter of the small diameter portion is 0.7~0.8 times the outer diameter of the large diameter portion.

5. The tubular body as claimed in claim 1, wherein the bridge portion is shaped as a cone and has a small diameter end at the front end thereof and has a large diameter end at the rear end thereof.

6. The tubular body as claimed in claim 1, further comprising:

an opening provided in a peripheral wall of the large diameter portion; and a gripping area formed between a rear end of the opening and a rear end of the tubular body.

7. The tubular body as claimed in claim 6, wherein the opening has a length, and the length of the opening is not greater than one half of the length of the large diameter portion.

8. The tubular body as claimed in claim 6, wherein a layout length is defined as a distance from a front end of the tubular body to the rear end of the opening and the layout length is 0.67~0.86 times the length of the tubular body; the gripping area has a gripping area length, and the gripping area length is 0.45~0.51 times the length of the large diameter portion.

9. The tubular body as claimed in claim 8, wherein the layout length is 0.69~0.85 times or 0.71~0.73 times the length of the tubular body.

10. The tubular body as claimed in claim 6, wherein the opening has a depth, and the depth of the opening is about one half of the outer diameter of the large diameter portion.

11. The tubular body as claimed in claim 1, further comprising the connecting member, the connecting member has a lug portion and the rod portion, the rod portion extends into the tubular body through the front end of the small diameter portion and is connected to the small diameter portion, and the lug portion is exposed from the tubular body.

12. The tubular body as claimed in claim 11, wherein the lug portion has a width and the width of the lug portion is greater than the outer diameter of the small diameter portion.

* * * * *